US007258481B2

(12) United States Patent
Zachmann

(10) Patent No.: US 7,258,481 B2
(45) Date of Patent: Aug. 21, 2007

(54) MULTIINDICATOR DEVICE AND METHOD FOR CALIBRATING/SETTING SAME

(75) Inventor: Helmut Zachmann, Remchingen (DE)

(73) Assignee: Timex Group B.V. (NL)

( * ) Notice: Subject to any disclaimer, the term of this patent is extended or adjusted under 35 U.S.C. 154(b) by 280 days.

(21) Appl. No.: 11/022,435

(22) Filed: Dec. 22, 2004

(65) Prior Publication Data

US 2006/0133216 A1 Jun. 22, 2006

(51) Int. Cl.
*G04B 18/00* (2006.01)

(52) U.S. Cl. ..... 368/185; 368/81

(58) Field of Classification Search ..... 368/76, 368/80, 81, 185–187, 228, 231
See application file for complete search history.

(56) References Cited

U.S. PATENT DOCUMENTS 4,246,602 A * 1/1981 Sekiya et al. ..... 368/71
4,470,707 A * 9/1984 Chambon et al. ..... 368/74
5,379,281 A * 1/1995 Koch ..... 368/72
5,619,478 A * 4/1997 Mutoh ..... 368/72
5,673,238 A * 9/1997 Berney ..... 368/80
5,959,941 A * 9/1999 Murakami et al. ..... 368/80
2003/0112708 A1 6/2003 Fujisawa et al.
2004/0233791 A1* 11/2004 Plancon et al. ..... 368/80

FOREIGN PATENT DOCUMENTS

EP 0 589 465 3/1994
GB 2 087 601 5/1982

* cited by examiner

*Primary Examiner*—Vit Miska
*Assistant Examiner*—Sean Kayes
(74) *Attorney, Agent, or Firm*—Carmody & Torrance LLP

(57) ABSTRACT

A method of setting/calibrating at least two display hands in an electronic device, wherein the method comprises the steps of initiating an actuation sequence of the setting/calibration mechanism; causing the first of the at least two display hands to rotate at least in one of a clockwise and counterclockwise direction and in a manner that is independent of the actuation sequence; initiating a hand selection sequence via a selection mode to select the second of the at least two display hands to be set/calibrated; and while preventing the first of the at least two display hands from rotating, causing the second of the at least two display hands to rotate in at least one of a clockwise and counterclockwise direction and in a manner independent of the hand selection sequence; wherein the second of the at least two display hands would be next for setting/calibrating.

12 Claims, 5 Drawing Sheets

MULTIINDICATOR DEVICE AND METHOD FOR CALIBRATING/SETTING SAME

BACKGROUND OF THE INVENTION

The present invention is directed generally to electronic devices that have at least two display hands (e.g. a chronograph watch or other multidisplay electronic device such as that disclosed in coowned and copending application Ser. No. 10/441,417), and in particular, to an improved methodology for setting/calibrating each of the two display hands. An electronic device that carries out the foregoing method is also provided.

Ideas to assist users in setting and/or calibrating an electronic device, such as a wristwatch, are broad and varied. For example, in watches commonly referred to as "digital" watches actual printed text may be provided along the bezel of the device (or on the display itself) to prompt users through a setting and/or calibration sequence.

In "analog" watches, the idea of printing on the watch bezel is less than desirable, and may even be less than practical since limited information, if any at all, can be provided on the bezel itself while still remaining aesthetically pleasing. Therefore, a perceived deficiency in the prior art is the ability to provide a user with easy to remember steps for setting/calibrating a plurality of display hands in an electronic device of the "analog" type.

There is a need to overcome the aforementioned deficiencies. In particular, there is a need to provide users with a method of more easily understanding the setting/calibrating sequence for a plurality of display hands in an electronic device of the "analog" type. Specifically, there is a need to provide an interface that assists the user through a setting/calibration sequence for a plurality of display hands in an electronic device.

It is believed that the foregoing is best achieved by moving, such as by rotating (e.g. "spinning," "wiggling," "waggling" and/or "oscillating") the display hand that is next available for setting/calibration. In this way, the user need not remember complicated sequences or the order in which the hands are set and/or calibrated since the device will in effect prompt the user accordingly.

SUMMARY AND OBJECTIVES OF THE INVENTION

It is thus an objective of the present invention to overcome the perceived deficiencies in the prior art.

Specifically, it is an objective of the present invention to provide an improved user interface for setting and/or calibrating one or more display hands in an electronic device.

Moreover, it is an object of the present invention to provide an improved user interface that facilitates a user's ability to set and/or calibrate one or more display hands in an electronic device, such as, but not limited to, a timepiece (e.g. a watch).

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed to a method of setting/calibrating at least two display hands in an electronic device, wherein each of the at least two display hands is independently and operatively coupled to an actuation mechanism that rotates its associated display hand in at least one of a clockwise and counterclockwise direction in response to actuation of a setting/calibration mechanism, wherein the method comprises the steps of initiating an actuation sequence of the setting/calibration mechanism; causing the first of the at least two display hands to rotate at least in one of a clockwise and counterclockwise direction and in a manner that is independent of the actuation sequence; initiating a hand selection sequence via a selection mode to select the second of the at least two display hands to be set/calibrated; and while preventing the first of the at least two display hands from rotating, causing the second of the at least two display hands to rotate in at least one of a clockwise and counterclockwise direction and in a manner independent of the hand selection sequence; wherein the second of the at least two display hands would be next for setting/calibrating.

An electronic device that carries out the foregoing method is also provided.

BRIEF DESCRIPTION OF THE DRAWINGS

For a fuller understanding of the invention, reference is had to the following description taken in connection with the accompanying figures, in which.

Identical reference numerals in the figures are intended to indicate like parts, although not every feature in every figure may be called out with a reference numeral.

DETAILED DESCRIPTION OF THE PREFERRED EMBODIMENTS

The present invention is directed to a method of setting and/or calibrating display hands in an electronic device, which in the preferred embodiment, is a wristwatch. However, it should be understood that the present invention need not be a wristwatch, as other devices are very much contemplated hereby, and thus covered by the present claims. Reference should be made to co-owned and co-pending application Ser. No. 10/441,417, the disclosure of which is incorporated by reference as if fully set forth herein, which makes it clear that the device of the present invention can be a heartrate monitor and/or a compass, just to name a few, the only important feature being that there are a plurality of (i.e. two (2) or more) display hands.

To be sure, the present invention is applicable to a wide variety of devices and applications. That is, while the following embodiments will be disclosed in connection with the setting and/or calibrating of a plurality of display hands on a timepiece, and in particular, wherein each of the display hands are individually associated with a date related display, the scope of the invention is not so limiting. For example, the hands may relate to speed and distance measurements, or heartrate and/or blood pressure measurements, astronomical data, sun/moon phases, the tide, altimeter readings and/or time related measurements, just to name a few.

Figure 1:
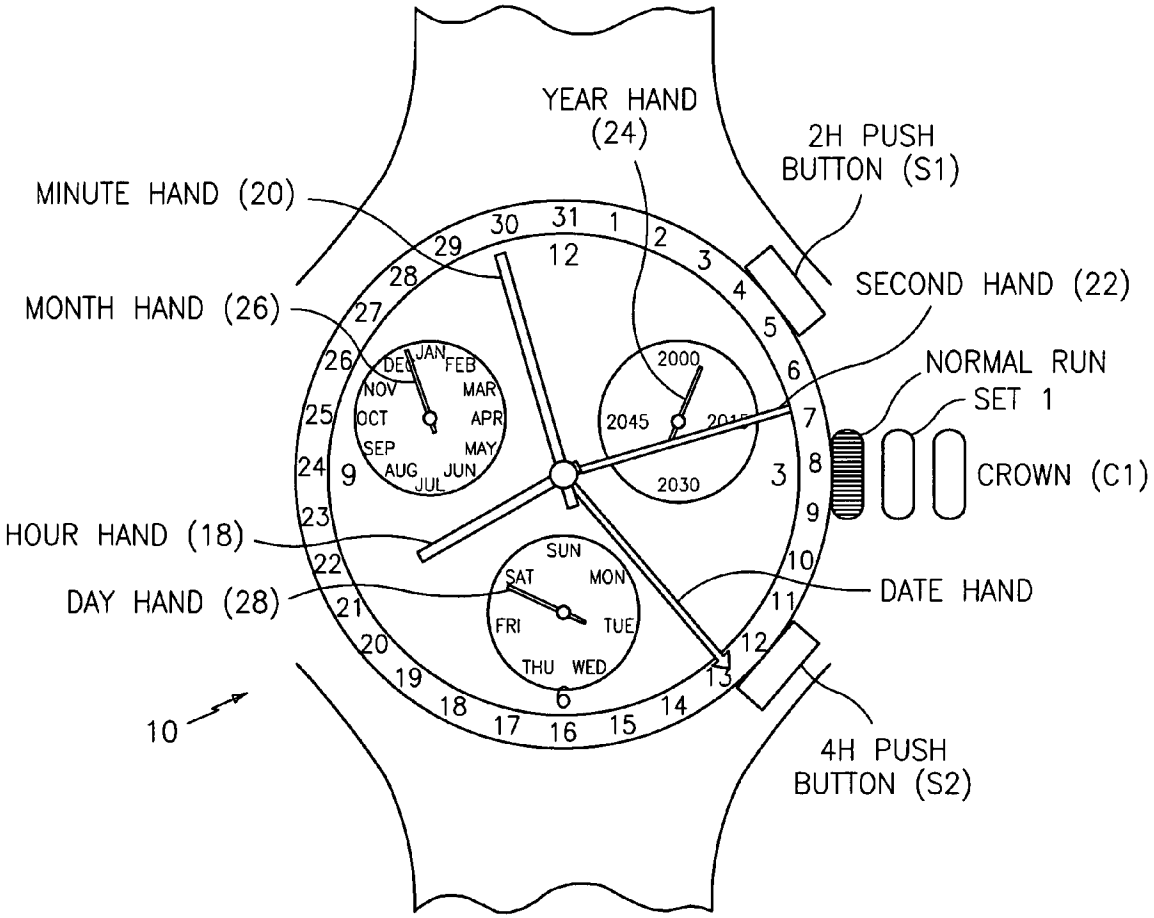
FIG. 1 is a top plan view of an electronic device constructed in accordance with the present invention.
Figure 2:
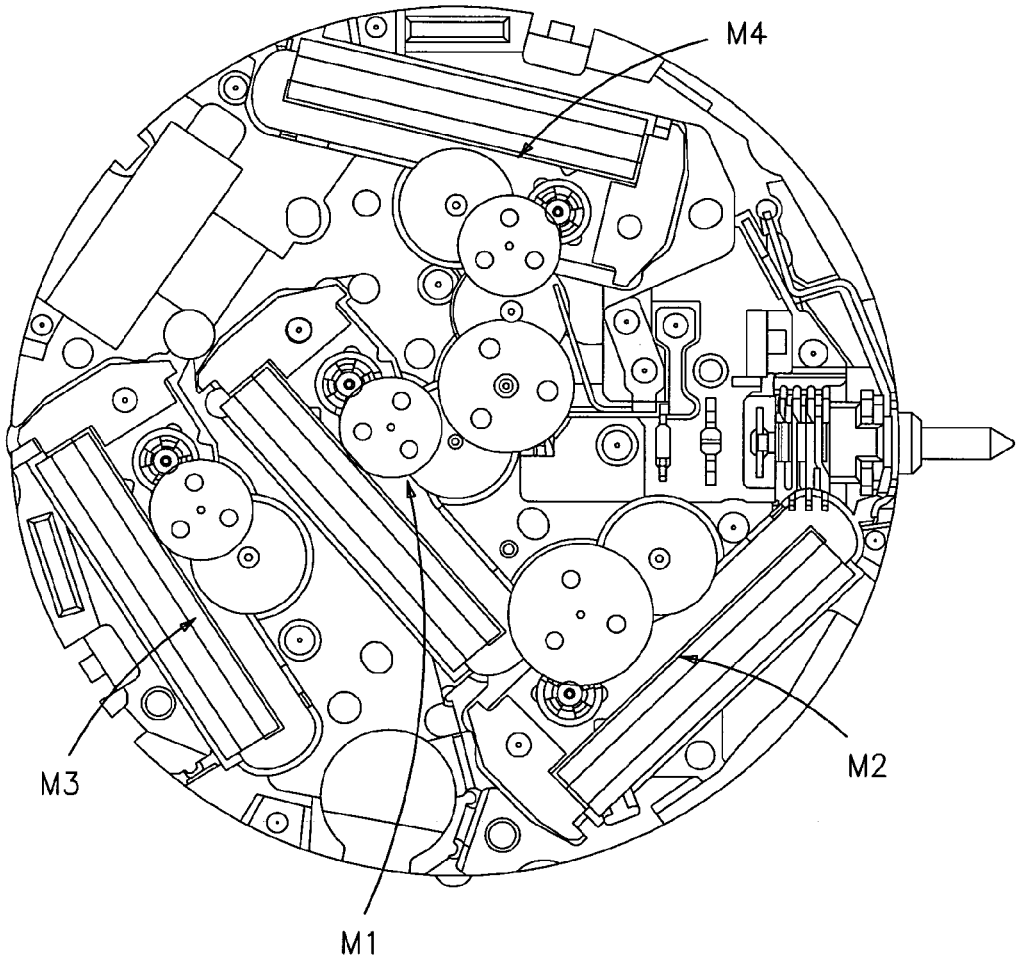
FIG. 2 is a plan view of the underside of the electronic device illustrated in FIG. 1.

Reference is first made generally to FIGS. 1-2, which illustrate an electronic device, generally indicated at 10, constructed in accordance with the present invention. Many of the details of FIGS. 1-2 will be omitted for purposes of brevity, but the reader is invited to read copending and coowned application Ser. No. 10/730,200 and Ser. No. 10/441,417, the disclosures of which are incorporated by reference as if fully set forth herein, for a more complete detailed description of how a controller, as set forth by reference number 100 therein, can individually control and operate each of the display hands. These applications also disclose many other non-essential details related to the present invention.

For example, the present disclosure omits, for purposes of brevity, certain basic and very well known concepts regarding the construction of an analog or chronograph watch. For example, the basic construction and arrangements of gears and/or gear trains to rotate a plurality of "standard" hands all supported on a center stem, such as an hour hand, a minute hand and a "seconds" hand, will be omitted as being well within the purview of one skilled in the art. Similarly omitted is the well-known method of individually setting "other" display hands, such as those found in a conventional chronograph watch. Likewise, the selected movement of yet additional display hands, coined "dash" hands, is more specifically disclosed in the aforementioned '417 application.

Reference is briefly made to FIG. 2, to more particularly illustrate four stepper motors, each respectively and generally indicated by M1, M2, M3 and M4. One skilled in the art would recognize that varying the number of display hands can vary the number of needed stepper motors, all of which is within the scope of the present invention and disclosure. As positioned in the module of the present invention, motor M1 is provided to rotate hour hand 18, minute hand 20 and second hand 22 all in a known manner.

Specifically, hour hand 18, minute hand 20 and second hand 22 are coupled to a gear train for conveying the rotational activity generated by the rotor of motor M1. In a similar manner, hand 24 is rotated by stepper motor M2, and a gear train is provided to convey the rotational activity generated by the rotor of motor M2 to hand 24. Likewise, hands 26 and 28 are each respectively rotated by stepper motors M3 and M4, and respective gear trains may be provided to convey the rotational activity generated by the respective rotors of motors M3 and M4. The construction of the respective gear trains are well within the purview of one ordinarily skilled in the art.

Preferably, motors M2, M3 and M4 are bi-directional stepper motors thus being able to rotate in either direction, with as many as two rotor steps per revolution (or 180° per rotor step), and the construction of acceptable stepper motors to functionally operate in this manner are widely commercially available and well within the understanding of those skilled in the art. It should also be understood that it is well within the skill of the designer to design an appropriate gearing ratio to provide for the desirable display rotation or movement of display hands 24, 26, 28. That is, it may be desirable for the incremental rotation of the hands to be quite small, thus providing for precise increments and display measurements. For example, in the preferred embodiments, where display hands 24, 26, 28 may need to move in precise increments, it is desirable to have very precise movement thereof, and the ratio of the gear train from its associated motor to the display hands will be accordingly provided.

A discussion of specific circuit diagrams for a preferred construction of electronic device 10 is believed to be unnecessary, and reference to application Ser. No. 10/441,417 and those other applications identified herein can be made for such details.

Switches S1 and S2 are intended to generically indicate both side/top mounted pushers and C1 indicates the setting stem/crown. Obviously, switches S1 and S2 are intended to be actuated by pushing while setting stem/crown C1 can be axially displaced and/or rotated in a clockwise and/or counterclockwise direction, as set forth best in application Ser. No. 10/331,827, the disclosure of which is also incorporated by reference as if fully set forth herein. Collectively and individually, pushers S1 and S2 and setting stem/crown C1 shall be deemed the "setting/calibration" mechanism of the present invention. All other features and components, including the aforementioned features, etc. will find correspondence in the above-identified applications, most specifically in application Ser. No. 10/441,417 and Ser. No. 10/730,200.

Turning to the specifics of the present invention, an advantageous feature is that one or more hands, such as hand 24, 26, 28 may oscillate at some frequency, such as 1 Hz (although other faster or slower rates are certainly within the purview of one skilled in the art and are only limited by design choice and or the constraints of the particular components (such as the rotation rate of the rotor)), when operating in the setting/calibration mode, to allow the user to know which is the next hand for setting/calibration. Such a feature is achieved by rotating the rotor of the respective stepper motor, again, in the present illustration, an appropriate number of pulses in the forward and reverse direction at the desired frequency while the timer is operational, all the while ensuring that the controller (finding correspondence in controller 100 in the aforementioned '417 application) maintains information on the rotor position so that the proper rotation of the rotor can be effectuated during actual setting and/or calibration.

Figure 3:
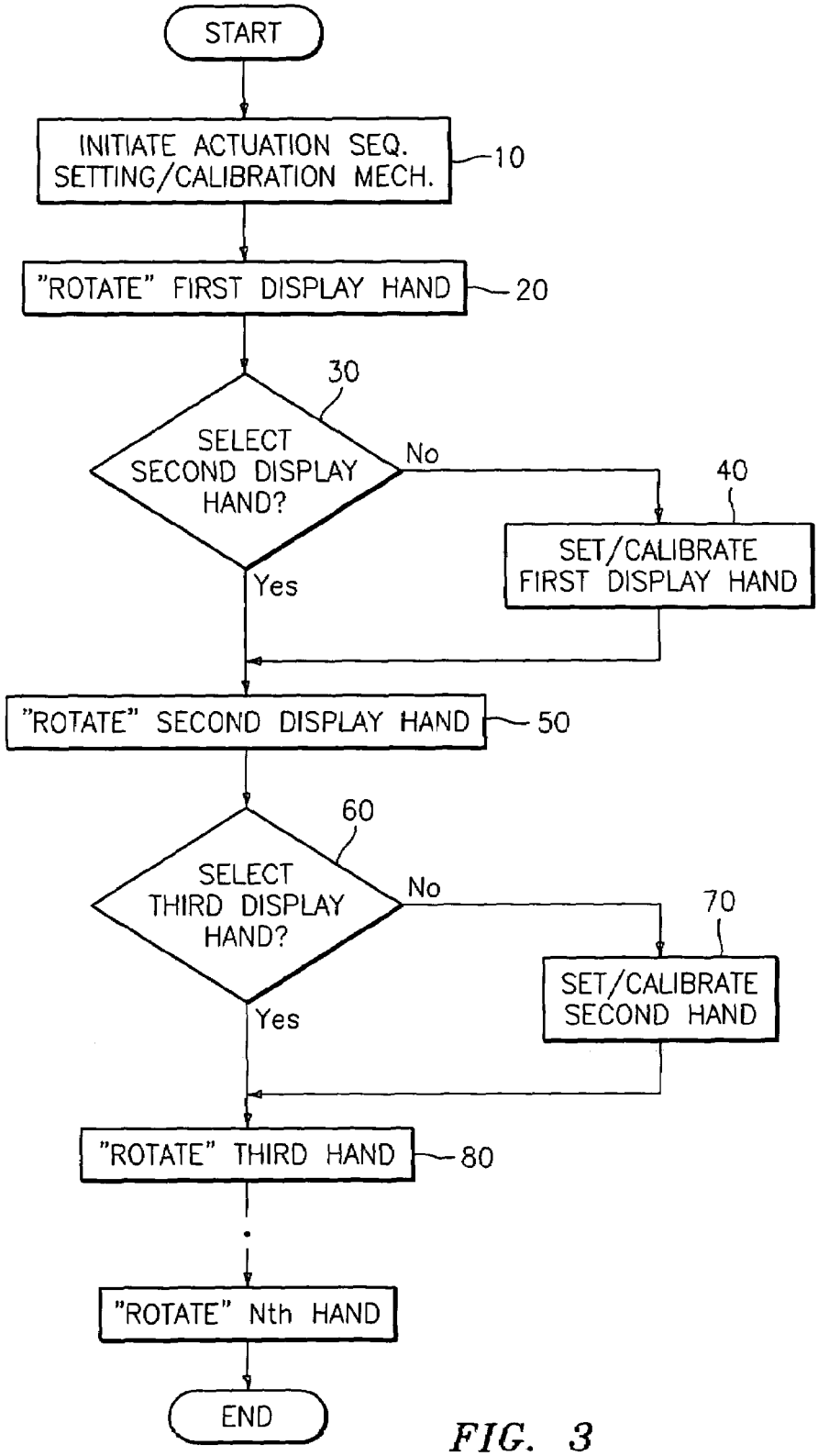
FIG. 3 is a flowchart of a preferred methodology for carrying out the present invention.
Figure 4:
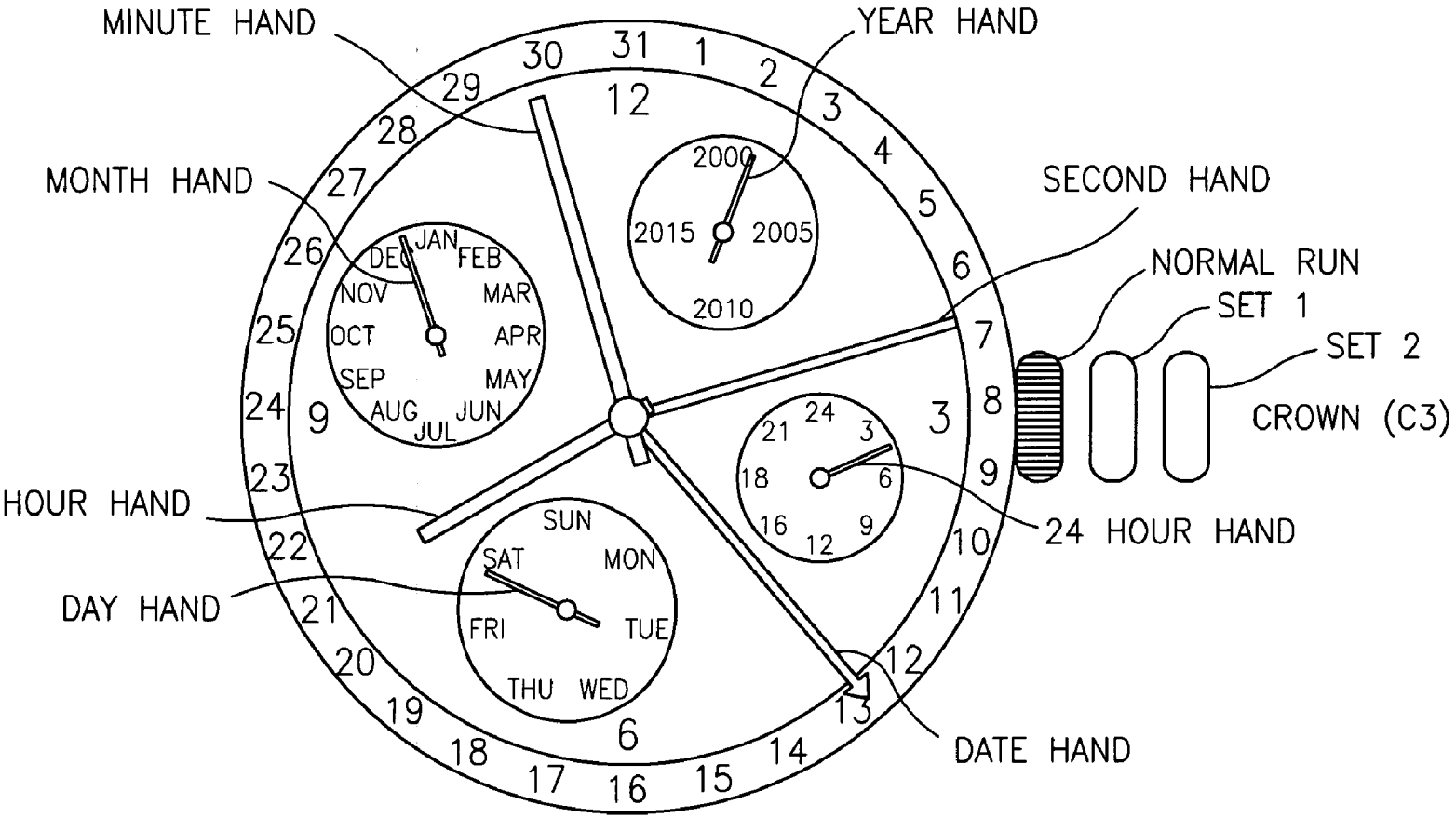
FIG. 4 is the face of an electronic device (e.g. timepiece) with an exemplary different arrangement of displays and display hands.
Figure 5:
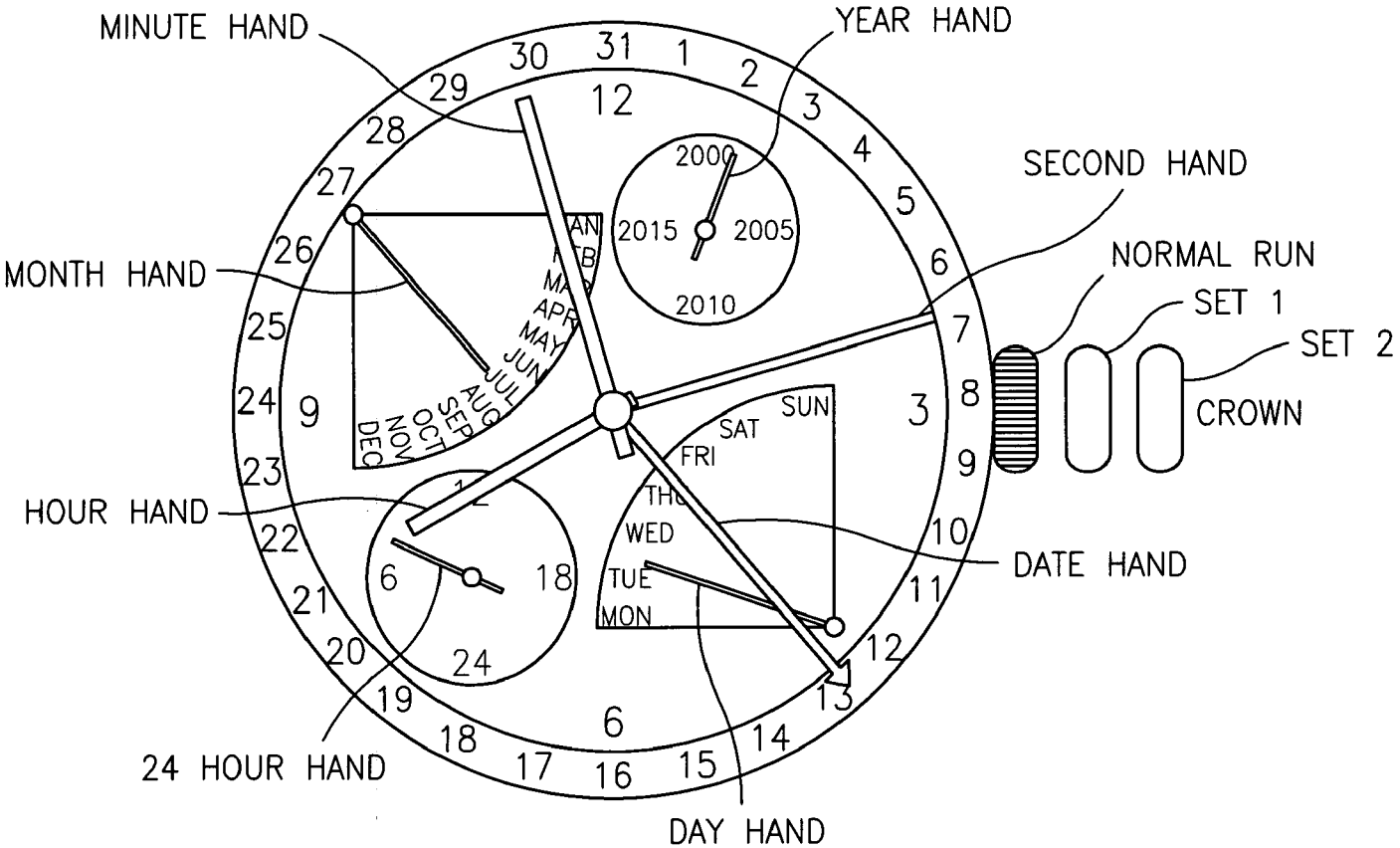
FIG. 5 is yet another exemplary arrangement of displays and display hands that can advantageously incorporate and utilize the present invention.

Turning to the particulars of the present invention, reference is now made to FIG. 3 in connection with the following text for an understanding of the preferred methodology of the present invention. Specifically, the method preferably begins with electronic device 10 entering the setting/calibration mode. The term "setting/calibration" (and all forms of the words (e.g. "set/calibrate")) is intended to broadly cover any setting and/or calibrating operation of the particular display hand. For example, in the context of a hand displaying dates of the month, turning the hand from the $31^{st}$ position to the $1^{st}$ position would be deemed to be "setting/calibrating" the hand. Similarly, resetting of the hand to a zero (0) position would also be "setting/calibrating" the hand. Therefore, and generally speaking, the intentional movement of the hand by a user interfacing with the device (as opposed to the natural internal progression of the hands) should be deemed to be "setting/calibrating" of the hand.

Accordingly, the preferred methodology begins with the initiation of an actuation sequence, which in the preferred embodiment, is achieved by the actuation of the setting/calibration mechanism (Step 10). Specifically, this can be achieved by a particular button push (or sequence of several button pushes) or crown rotation, or preferably with a pull of the crown into a second of at least two axial positions.

With electronic device 10 now in the setting/calibration mode, a first of the plurality of display hands (e.g. year hand 24) will begin to rotate in a clockwise and/or a counterclockwise direction. The rotation will also preferably be in a manner independent of the actuation sequence.

By the phrase "rotate in a clockwise and/or a counterclockwise direction" or the more accepted claim language "in at least one of a clockwise and counterclockwise direction" it is intended to mean that the particular display hand will do one of two things, namely it will toggle back and forth (e.g. "waggle", "wiggle" or "oscillate") or it may spin, e.g. 360°, and may do so both/either in a clockwise and/or a counterclockwise direction (all generically referred to as "rotate"). A "wiggling", "waggling" or "oscillating" ability of the hand is disclosed in the aforementioned application Ser. No. 10/730,200. The purpose of using such language is to appreciate the ability for any and all display hands to act in accordance with the preferred methodology, whether they are operatively coupled to a bidirectional stepping motor (able to both spin and "waggle") or a unidirectional stepping motor (unable to "waggle" but rather only spin, due to its limitation of only being able to rotate in one direction).

Secondly, reference to the ability of the hand rotating "in a manner that is independent of the actuation sequence" is intended to distinguish the inventive feature from prior art devices that provide for hand movement in stepped increments in direct response to specific actuations of a setting/calibration mechanism. That is, in the prior art, a single button press may cause the hand to move one unit, two successive button presses may cause the hand to move two units, or continued actuation may cause the hand to spin, etc. In distinction, the present language is intended to imply, for example, that a simple actuation of the setting/calibration mechanism (e.g. a single button push or a "pull" of the setting stem) may cause the display hand to "wiggle/waggle" back and forth one or more times, or may cause the hand to rotate 360° around one or more times. In this way, the movement of the hand is not immediately consistent with what the prior art hand does when a button is depressed once, for example.

In the preferred methodology, there is preferably a timed delay (e.g. 3 or 5 seconds) from the initial actuation of the setting/calibration mechanism (i.e. to place electronic device 10 in the setting/calibration mode) to the actual commencement of rotation of hand 24 in the clockwise or counterclockwise direction (Step 20). With the first of the display hands (e.g. year hand 24) now rotating (e.g. "waggling" or spinning), the user then either sets/calibrates hand 24 (Step 40) or selects the next (e.g. month) hand 26, via the initiation of a hand selection sequence for setting/calibration (Step 30).

If the user wishes to begin setting/calibrating display hand 24 (Step 40), the user need only commence the setting/calibration thereof within a predetermined period of time. For example, setting/calibrating display hand 24 may be achieved by rotating the setting stem (i.e. crown) or repeated (or continuous) actuation of one of the pushers. Once the setting of display hand 24 is complete (determined by, for example, and not limitation, inaction of any actuation of the setting/calibration mechanism for a period of time (e.g. 3 seconds) or particular actuation of the setting/calibration mechanism (e.g. depression of a selected pusher)) control passes to Step 50, wherein the next (e.g. month) hand 26 begins to rotate in one of the clockwise and/or counterclockwise directions.

Step 30 provides for the option should no setting/calibration of display hand 24 be needed/desired. In such a situation, mere inaction on the part of the user for a predetermined period of time (e.g. 3 or 5 seconds) subsequent to the commencement of rotation of display hand 24 would be sufficient to begin the "rotation" (i.e. Step 50) of display hand 26 in the clockwise and/or counterclockwise direction. In this way, the inaction of the user to set/calibrate display hand 24 during the predetermined time period or a deliberate initiation of the hand selection sequence via the selection mode (e.g. pressing of switches) may be deemed to meet the step of selecting the next of the display hands to set/calibrate, as the inaction or deliberate action is the recited "initiation of a hand selecting sequence via the selection mode" wherein the mode of selection is either inaction after a predetermined period of time or a predetermined actuation of the switching mechanism (e.g. button push or setting stem displacement in an axial direction, by way of example). Similarly, proceeding from Step 30 to Step 50 may be accelerated by initiation of the hand selection sequence.

With the methodology at Step 50, the next (e.g. month) hand 26 begins to rotate in a manner independent of the hand selection sequence and in the clockwise and/or counterclockwise direction. Preferably, at this step the only display hand that is rotating is month hand 26. Because it is the only rotating hand, the user will quickly and easily know which is the next hand for setting/calibrating, an objective of the present invention.

Continuing with the flowchart as set forth in FIG. 3, if the user wishes to select display hand 26 for setting/calibration, he/she merely commences the performance of the setting/calibration thereof (Step 70) (e.g. via pushers or rotation of the crown in a clockwise and/or counterclockwise direction) within a predetermined period of time (e.g. 3 or 5 seconds). Once the setting of display hand 26 is complete (again determinable by, for example, and not limitation, inaction of any actuation of the setting/calibration mechanism for a period of time (e.g. 3 seconds) or particular actuation of the setting/calibration mechanism (e.g. depression of a selected pusher or particular rotation/axial displacement of the setting stem)) control passes to Step 80, wherein the next (e.g. day) hand 28 begins to rotate in one of the clockwise and/or counterclockwise directions in a consistent manner to that set forth above.

In a likewise manner, the present methodology provides for the decision that no setting/calibration of display hand 26 was needed/desired. In such a situation, mere inaction on the part of the user for the aforementioned predetermined period of time (e.g. 3 or 5 seconds) subsequent to the commencement of rotation of display hand 26 would be sufficient to begin the rotation (i.e. Step 80) of display hand 28 in the clockwise and/or counterclockwise direction. Similarly, one or more predetermined pusher pushes may also accelerate the methodology from Step 70 to Step 80. In this way, the inaction of the user to set/calibrate display hand 26 during the predetermined time period or a deliberate actuation of the switching mechanism is deemed to meet the feature (Step 60) of selecting the next of the display hands to set/calibrate, as the inaction or deliberate action is the recited "selecting via a selection mode" wherein the mode of selection is either inaction after a predetermined period of time or a predetermined actuation of the switching mechanism (e.g. button push or setting stem displacement in an axial direction).

With the methodology at Step 80, the next (e.g. date) hand 28 begins to rotate in a manner independent of the hand selection sequence. Likewise, at this Step 80 the only display hand that is rotating is date hand 28. Because it is the sole rotating hand, the user will quickly and easily know which is the next hand for setting/calibrating.

As illustrated in FIG. 3, the foregoing sequence of steps can be expanded to any number of display hands. In this way, a very simple, intuitive, easy to follow (and user friendly) method of setting/calibrating a plurality of display hands in an electronic device is provided.

Exiting of the setting/calibration mode is likewise preferably achieved by axial displacement of the setting stem back to the "normal" or run position as set forth in the applications incorporated by reference herein.

In accordance with the foregoing, it should be clear that the present embodiment successively rotates each of the at least two display hands (e.g. hands 24, 26) and wherein only the last of the display hands to rotate (i.e. the one that is currently rotating) independent of the mode of selection (i.e. "waggling" or spinning, is settable/calibratable).

Again, it should be clear that while the present invention is illustrated with respect to a display illustrating differing date information, this is by way of example and not limitation as the present invention is applicable to a wide variety of applications.

Accordingly, it will be seen that the present invention provides the ability to indicate which display hand is next for setting and/or calibration, and is achieved by one of "waggling" or spinning of the display hand, thus facilitating the setting/calibrations of a plurality of display hands in a analog type electronic device.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. A method of setting/calibrating at least two display hands in an electronic device, wherein each of the at least two display hands is independently and operatively coupled to an actuation mechanism that rotates its associated display hand in at least one of a clockwise and counterclockwise direction in response to actuation of a setting/calibration mechanism, wherein the method comprises the steps of:

initiating an actuation sequence of the setting/calibration mechanism;

indicating the first hand to be set/calibrated by causing the first of the at least two display hands to rotate at least in one of a clockwise and counterclockwise direction and in a manner that is independent of the actuation sequence;

initiating a hand selection sequence via a selection mode to select the second of the at least two display hands to be set/calibrated; and while preventing the first of the at least two display hands from rotating, indicating the second hand to be set/calibrated by causing the second of the at least two display hands to rotate in at least one of a clockwise and counterclockwise direction and in a manner independent of the hand selection sequence;

wherein the second of the at least two display hands would be next for setting/calibrating.

2. The method as claimed in claim 1, including the step of setting/calibrating the first of the at least two display hands prior to the step of initiating the hand selection sequence to select the second of the at least two display hands to set/calibrate.

3. The method as claimed in claim 1, including the step of setting/calibrating the second of the at least two display hands after initiating the hand selection sequence.

4. The method as claimed in claim 1, wherein the step of selecting the second of the at least two display hands for setting/calibrating comprises the step of actuating the setting/calibration mechanism.

5. The method as claimed in claim 1, wherein the step of selecting the second of the at least two display hands for setting/calibrating comprises the step of refraining from actuating the setting/calibration mechanism for a predetermined period of time.

6. The method as claimed in claim 1, including the steps of successively rotating each of the at least two display hands and wherein only the last of the display hands to rotate, independent of the hand selection sequence, is settable/calibratable.

7. The method as claimed in claim 1, including at least a third display hand and an actuation mechanism operatively coupled thereto, for rotating the third hand in at least one of a clockwise and counterclockwise direction; wherein each of the first, second at least third hands are independently selectable for setting/calibration by the setting/calibration mechanism; wherein the method comprises the step of:

being able to next set/calibrate only the display hand that had just rotated in response to the hand selection sequence.

8. A method of setting/calibrating at least two display hands in an electronic device, wherein each of the at least two display hands is independently and operatively coupled to an actuation mechanism that rotates its associated display hand in at least one of a clockwise and counterclockwise direction in response to actuation of a setting/calibration mechanism, wherein the method comprises the steps of:

initiating an actuation sequence of the setting/calibration mechanism;

causing the first of the at least two display hands to rotate at least in one of a clockwise and counterclockwise direction and in a manner that is independent of the actuation sequence;

initiating a hand selection sequence via a selection mode to select the second of the at least two display hands to be set/calibrated:

while preventing the first of the at least two display hands from rotating, causing the second of the at least two display hands to rotate in at least one of a clockwise and counterclockwise direction and in a manner independent of the hand selection sequence;

wherein the second of the at least two display hands would be next for setting/calibrating; and indicating a next hand to set/calibrate by rotating the next hand to be set/calibrated in one of a clockwise and counterclockwise direction, wherein the next hand to be set/calibrated rotates prior to the setting/calibration step and wherein the next hand rotates while all other display hands are prevented from rotating.

9. An electronic device with at least two display hands each of which are independently settable/calibratable, wherein each of the at least two display hands is independently and operatively coupled to an actuation mechanism that rotates its associated display hand in at least one of a clockwise and counterclockwise direction, wherein the electronic device comprises:

setting/calibration means for at least placing the electronic device in a setting/calibrating mode and for selecting each of the at least two display hands for setting/calibration; and means operatively coupled to the actuation mechanisms and the setting/calibration means for indicating the first hand to set/calibrate by rotating the first hand to be set/calibrated in one of a clockwise and counterclockwise direction in a manner independent of an actuation sequence, wherein the first hand to be set/calibrated rotates prior to setting/calibration of the first hand and wherein the first hand rotates while all other display hands are prevented from rotating, initiating a hand selection sequence via a selection mode to select the second of the at least two display hands to be set/calibrated, and while the first of the at least two display hands does not rotate, indicating the second hand to be set/calibrated by rotating the second hand to be set/calibrated in one of a clockwise and counterclockwise direction in a manner independent of an actuation sequence, wherein the second hand to be set calibrated rotates prior to setting/calibration of the second hand and wherein the second hand rotates while all other display hands are prevented from rotating;

wherein the second of the at least two display hands would be next for setting/calibrating.

10. The electronic device as claimed in claim 9, wherein the means indicate a next hand to set/calibrate by rotating the next hand to be set/calibrated in one of a clockwise and counterclockwise direction, wherein the next hand to be set/calibrated rotates prior to the setting/calibration step and wherein the next hand rotates while all other display hands are prevented from rotating.

11. The method as claimed in claim 1, including the step of indicating the first hand to set/calibrate by rotating the first hand to be set/calibrated in one of a clockwise and counterclockwise direction, wherein the first hand to be set/calibrated rotates prior to the setting/calibration step of the first hand and wherein the first hand rotates while all other display hands are prevented from rotating.

12. The method as claimed in claim 1, including the step of indicating the second hand to set/calibrate by rotating the second hand to be set/calibrated in one of a clockwise and counterclockwise direction, wherein the second hand to be set/calibrated rotates prior to the setting/calibration step of the second hand and wherein the second hand rotates while all other display hands are prevented from rotating.

* * * * *